US007926751B2

(12) United States Patent
Musch et al.

(10) Patent No.: US 7,926,751 B2
(45) Date of Patent: Apr. 19, 2011

(54) SYSTEMS AND METHODS FOR GRINDING COAL WITH SECONDARY AIR BIAS AND BOWL PRESSURE CONTROL LOOPS AND PERFORATION PLATES

(75) Inventors: Gregory A. Musch, Robinson, IL (US); Steve V. Miller, Palestine, IL (US)

(73) Assignee: Ameren Corporation, St. Louis, MO (US)

( * ) Notice: Subject to any disclaimer, the term of this patent is extended or adjusted under 35 U.S.C. 154(b) by 212 days.

(21) Appl. No.: 12/206,206

(22) Filed: Sep. 8, 2008

(65) Prior Publication Data

US 2009/0090799 A1 Apr. 9, 2009

Related U.S. Application Data

(60) Provisional application No. 60/978,318, filed on Oct. 8, 2007.

(51) Int. Cl.
*B02C 15/00* (2006.01)

(52) U.S. Cl. ..... 241/33; 241/117

(58) Field of Classification Search ..... 241/33, 241/117, 119, 57

See application file for complete search history.

(56) References Cited

U.S. PATENT DOCUMENTS 3,205,843 A 9/1965 Bogot
4,184,640 A 1/1980 Williams
4,402,462 A 9/1983 Lohnherr
4,498,633 A 2/1985 Williams
5,095,827 A 3/1992 Williams
5,137,218 A * 8/1992 Sutherland et al. ..... 241/31
5,277,134 A 1/1994 Schlessing et al.
5,839,673 A 11/1998 Williams
5,873,156 A 2/1999 Wark
5,944,270 A 8/1999 Farris
6,820,829 B1 11/2004 Oder et al.
7,028,931 B2 4/2006 Lin et al.

OTHER PUBLICATIONS www.turbinesales.com website page printed on Sep. 15, 2006.
www.pulverizers.net website page.

* cited by examiner

*Primary Examiner* — Faye Francis
(74) *Attorney, Agent, or Firm* — Senniger Powers LLP

(57) ABSTRACT

A grinding system includes a mill housing. A milling unit in the housing has a moveable milling member operable to grind coal. A drive system includes a drive shaft and at least one gear in a gear case drivingly connecting the milling member to the drive shaft. An exhauster is operable to draw air into the housing through an inlet and draw a mixture of air and powdered coal out of the housing through an outlet. A pressurization system is operable to maintain the gear case pressure at a higher pressure than an air pressure in the housing. In one method of grinding coal a gear case pressure is maintained at a pressure higher than a pressure at the housing inlet while the milling member grinds coal into a powder and the exhauster draws a mixture of powdered coal and air out of the housing.

14 Claims, 7 Drawing Sheets

SYSTEMS AND METHODS FOR GRINDING COAL WITH SECONDARY AIR BIAS AND BOWL PRESSURE CONTROL LOOPS AND PERFORATION PLATES

FIELD OF THE INVENTION

The present invention generally relates to systems for grinding a substance into a powder and more particularly to systems for grinding coal into a powder that is suitable for combustion in a coal burner.

BACKGROUND

Combustion of coal is commonly used for industrial heating applications. For example, coal fired electrical power plants burn coal to generate the steam used to drive their electrical generators. Coal combustion is also often used in other industries having significant heating requirements, such as metal works, cement plants, and the like.

Industrial applications using coal-fired combustion generally require the coal to be pulverized into a finely ground powder before it is ignited in the combustion chamber of a coal burner. The finely ground coal powder burns more efficiently and tends to produce fewer noxious byproducts than other forms of coal. However, powdered coal presents a significant explosion risk. In order to minimize the risk of explosion, the coal is typically ground into a powder by an on site coal mill just before the coal is fed to the burner.

One prior mill system used to grind coal into a powder and meter powdered coal to a coal burner is referred to as a negative pressure mill system. In a typical negative pressure mill system, an exhauster downstream of a mill housing draws hot air into the mill housing through an air inlet. A milling unit in the mill housing includes one or more milling elements rotated by a drive system in a manner that grinds the coal into fine particles. Coal is fed to the milling unit through a coal inlet and ground by the milling unit in the housing into powdered coal. The exhauster draws air and finely ground coal particles from the housing through an outlet of the mill housing. A classifier in the mill housing causes larger coal particles that are entrained in the air flow in the housing to fall back into the milling unit for further grinding, while at the same time allowing finely ground coal particles to remain entrained in the air flow exiting the mill housing. The exhauster has an outlet connected to the coal burner so that the mixture of air and powdered coal is blown into the combustion chamber of the burner by the exhauster. The suction from the exhauster maintains the pressure in the housing at a relatively low pressure, which is why coal mills of this type are referred to as negative pressure mills.

SUMMARY

One aspect of the invention is a system for grinding coal into a powder and supplying powdered coal to a burner. The system includes a mill housing having a coal inlet, an air inlet, and an outlet. A milling unit is in the mill housing. The milling unit is operable to receive coal that enters the housing through the coal inlet. The milling unit has a moveable milling member operable to grind the coal into a powder. The system also includes a drive system for moving the milling member. The drive system has a powered drive shaft and at least one gear for drivingly connecting the milling member to the drive shaft so that rotation of the drive shaft moves the milling member. A gear case defines a chamber. Said at least one gear is in the chamber. An exhauster is connected to the outlet of the mill housing. The exhauster is operable to draw air into the mill housing through the air inlet and further draw a mixture of air and powdered coal out of the mill housing through the outlet for delivery of the powdered coal to the burner. The system also has a gear case pressurization system operable to maintain a gear case pressure in the gear case at a higher pressure than an air inlet pressure at the air inlet.

Another aspect of the invention is a method of grinding coal into a powder. Coal is fed into a mill housing having a coal inlet, an air inlet, and an outlet, so that coal enters the mill housing through the coal inlet. A milling member in the mill housing is moved to thereby grind the coal into powdered coal by rotating a drive shaft drivingly connected to the milling member by at least one gear contained in a chamber defined by a gear case. Air is drawn into the housing through the air inlet and a mixture of air and powdered coal is drawn out of the housing through the outlet. Pressure in the gear case chamber in the gear case is maintained at a pressure higher than an air inlet pressure at the air inlet of the mill housing.

Still another aspect of the invention is a system for grinding coal into a powder and supplying powdered coal to a burner. The system includes a mill housing having a coal inlet, an air inlet, and an outlet. A milling unit is inside the mill housing. The milling unit is positioned to receive coal that enters the housing through the coal inlet. The milling unit has a moveable milling member operable to grind the coal into a powder when the milling member moves. The system also has a drive system for moving the milling member. The drive system has a powered drive shaft and at least one gear drivingly connecting the milling member to the drive shaft so that rotation of the drive shaft moves the milling member. A gear case defines a chamber. The at least one gear is in the chamber. An exhauster is connected to the outlet of the mill housing. The exhauster is operable to draw air into the mill housing through the air inlet and draw a mixture of air and powdered coal out of the housing through the outlet for delivery of the powdered coal to the burner. The system further includes a duct connected at one end to the air inlet of the mill housing so that the exhauster is operable to draw air from the duct into the mill housing through the air inlet. Another end of the duct is connected to a source of hot air. The hot air includes particulate matter. A duct pressurization system is operable to raise an air pressure in the duct upstream of the air inlet of the mill housing to be higher than ambient pressure.

BRIEF DESCRIPTION OF THE DRAWINGS

Corresponding reference characters indicate corresponding parts throughout the drawings.

DETAILED DESCRIPTION

Figure 1:
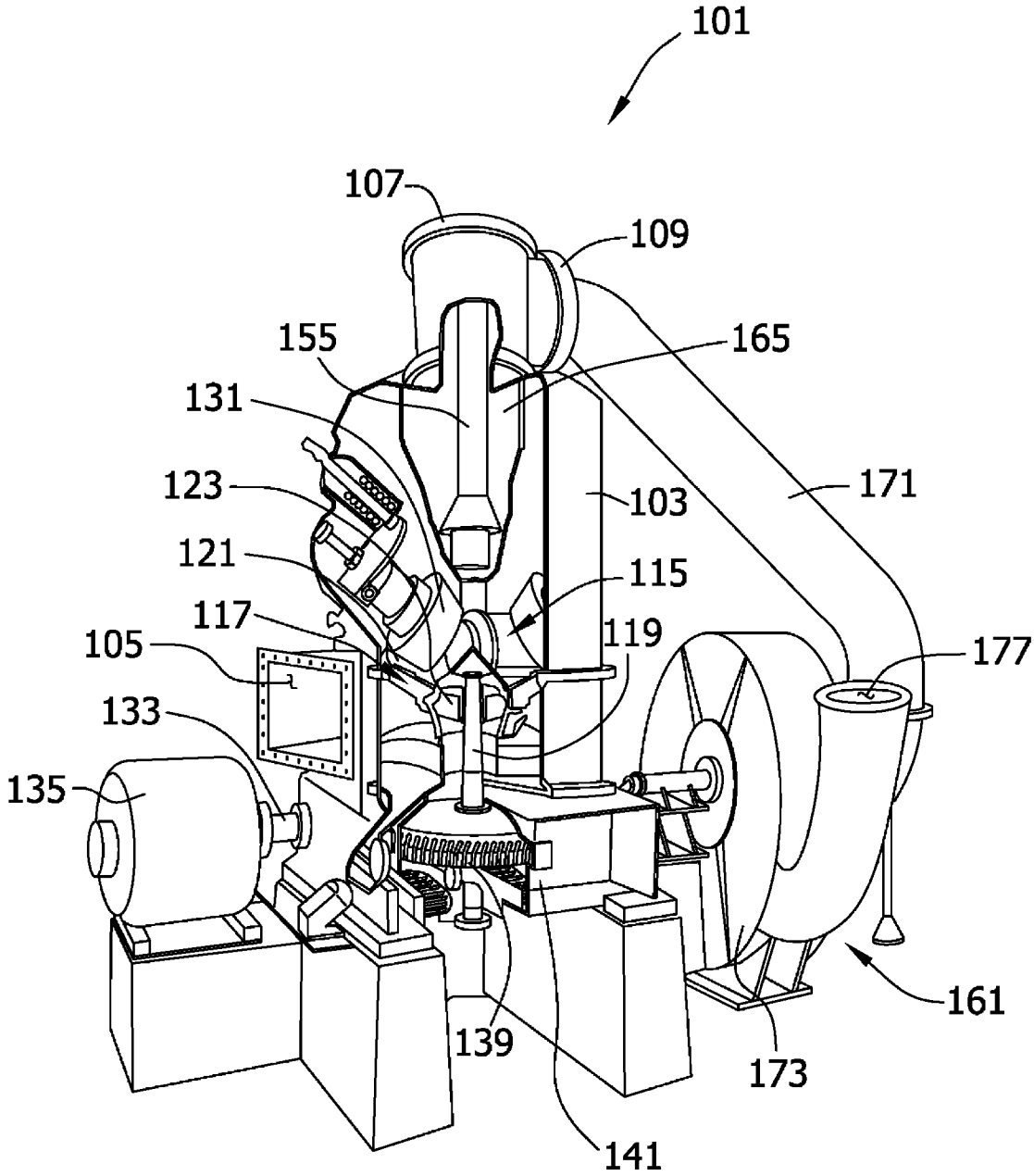
FIG. 1 is a perspective of a portion of a milling system of the present invention with a portion of a mill housing removed to show a milling unit inside the housing.

Referring to the drawings, and first to FIG. 1, one embodiment of a mill system for grinding coal is generally designated 101 and comprises a mill housing 103 having an air inlet 105, a coal inlet 107, and an outlet 109. The housing 103 contains a milling unit 115 including at least one moveable (e.g., rotatable) milling member 117. The milling unit 115 shown in FIG. 1, for example, includes a mill bowl 117 fixedly mounted on a bowl shaft 119 for rotation about a vertical axis. The sides of the mill bowl 117 are suitably inclined so the peripheral portion 121 of the mill bowl is higher than the central portion 123 of the mill bowl. One or more rollers 131 are biased to engage the upper surface of the peripheral portion 121 of mill bowl 117 so that cooperative action of the mill bowl and rollers pulverizes coal therebetween when the mill bowl is rotated. Other milling units can be used without departing from the scope of the invention.

Figure 2:
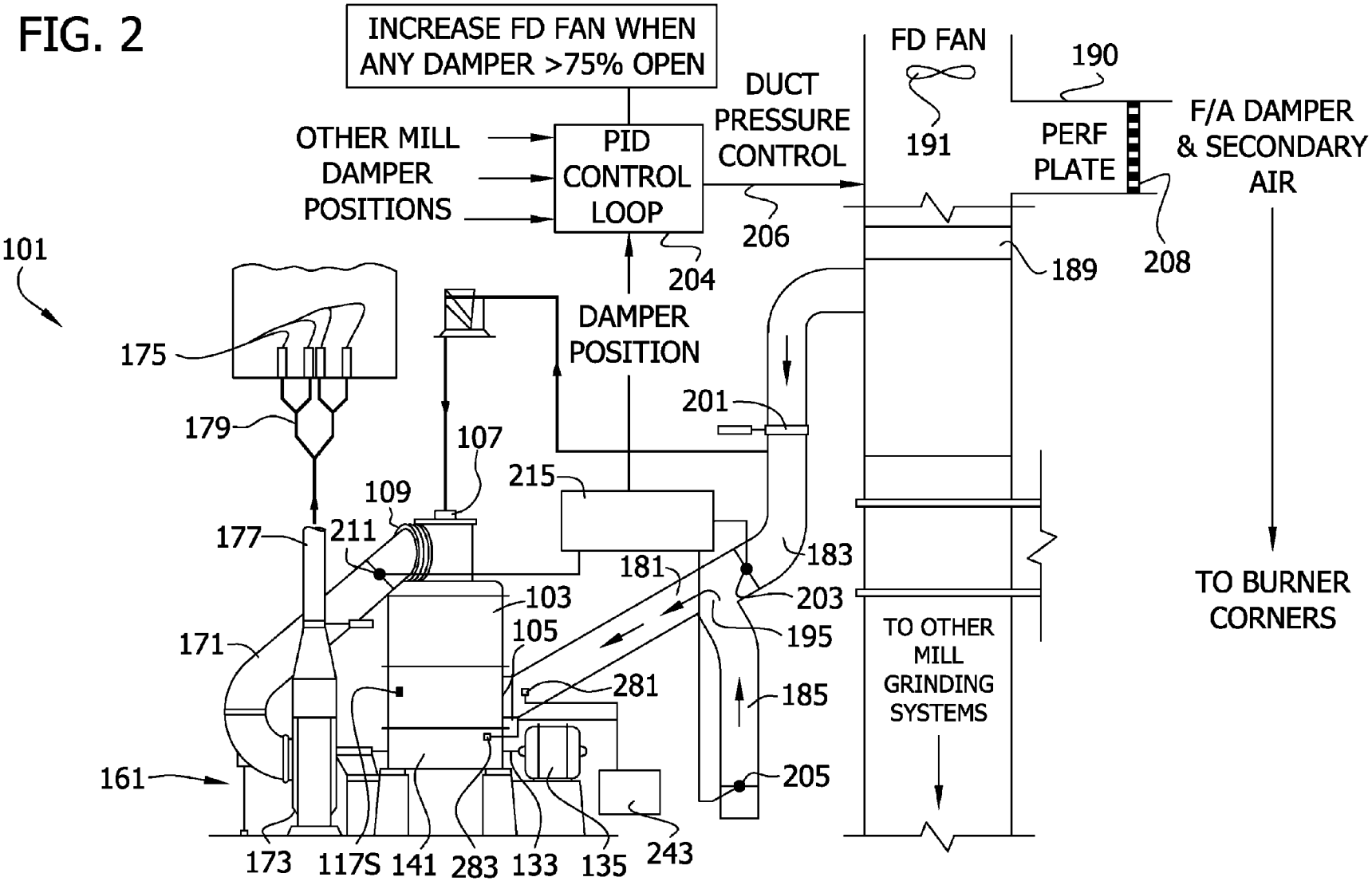
FIG. 2 is a schematic diagram of the milling system shown in FIG. 1, the layout of the schematic being modified from the layout in FIG. 1 for illustration purposes.
Figure 3:
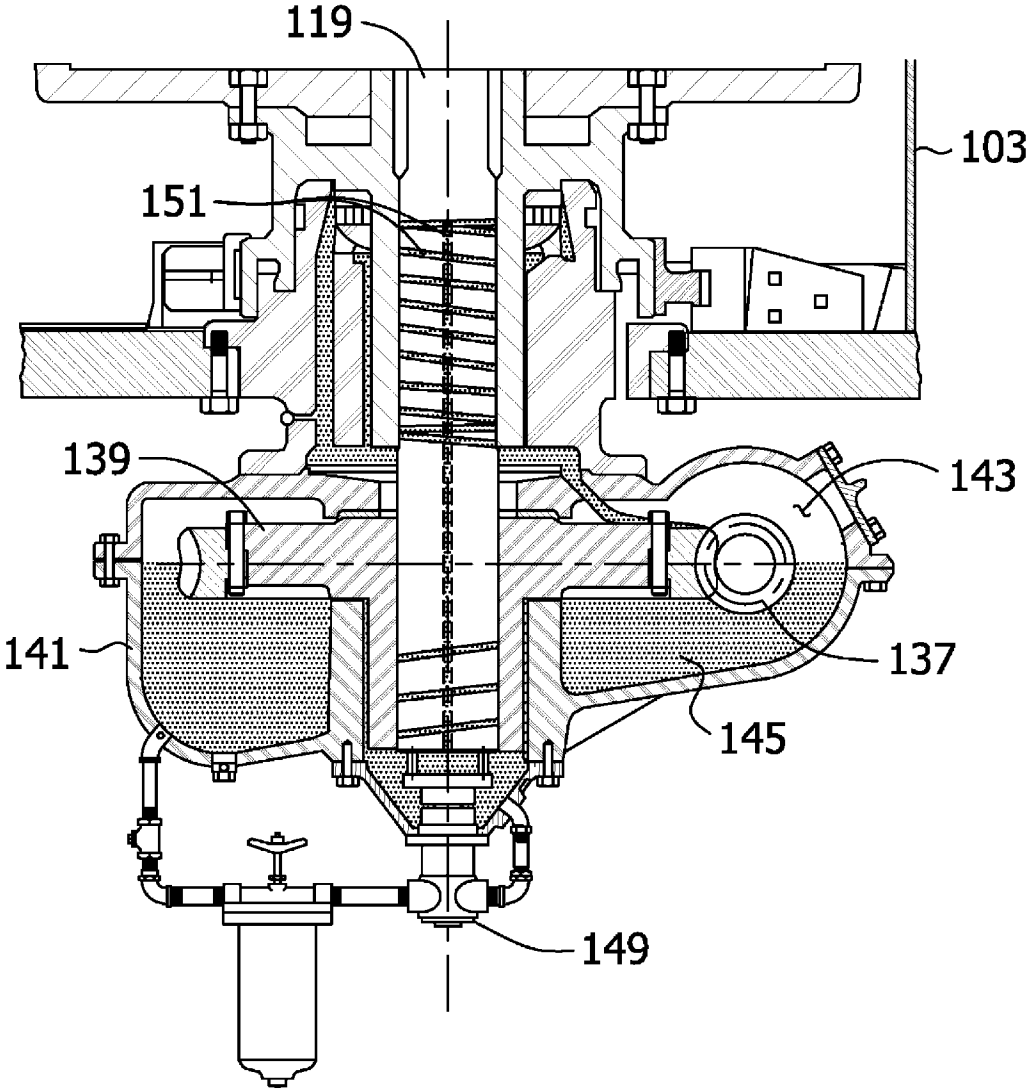
FIG. 3 is a cross section of a gear case of the coal mill shown in FIGS. 1 and 2.

The bowl shaft 119 is drivingly connected by at least one gear to a drive shaft 133 powered by a suitable power source, such as a motor 135 as illustrated in FIGS. 1 and 2. Referring to FIG. 3, for example, the gears of the illustrated embodiment include a worm gear 137 axially aligned with and fixedly mounted on the drive shaft 133 and a bull gear 139 enmeshed with the worm gear and fixedly mounted on the bowl shaft 119 so that rotation of the worm gear causes the bull gear to rotate about the axis of the bowl shaft, thereby rotating the bowl shaft and mill bowl 117. Other gears can be used within the scope of the invention. The gears 137, are contained in a gear case 141 that defines a chamber for containing the gears and a supply of lubricant 145. A pump 149 circulates the lubricant 145 through various channels (FIG. 3) in fluid communication with the chamber 143 and extending into the mill housing 103 to provide lubrication for rotation of the bowl shaft 119. The channels 151 and gear case chamber 143 are sealed from the interior of the mill housing by one or more seals (not shown) to keep the lubricant 145 from escaping the chamber and/or channels. The gear case 141 in the illustrated embodiment is primarily positioned below the mill housing 103. However, the gear case 141 can be positioned elsewhere relative to the mill housing 103 or in the mill housing without departing from the scope of the invention.

A coal feed mechanism, such a volumetric feeder (not shown), is connected to the coal inlet 107 so that the coal feed mechanism meters coal into the mill housing 103 through the inlet. In the embodiment shown in FIGS. 1 and 2, the coal inlet 107 is defined at the top of the mill housing and the coal feed mechanism includes a feed pipe 155 extending vertically into the housing through the coal inlet. The feed pipe 155 and mill bowl 117 are positioned relative to one another so that coal exiting the feed pipe falls onto the mill bowl. Centrifugal forces associated with rotation of the mill bowl 117 move coal from the central portion 123 of the mill bowl to the peripheral portion 121 of the mill bowl where it is pulverized by the cooperative action of the roller(s) and the mill bowl.

An exhauster 161 is connected to the outlet 109 of the mill housing 103 and is operable to draw air into the mill housing through the air inlet 105 by drawing air out of the housing through the outlet. Such an exhauster 161 is suitably conventional and need not be described in further detail. The air inlet 105 is suitably positioned at the base of the mill housing 103 and the outlet 109 is suitably at the top of the mill housing so that overall air flow through the mill housing is generally upward. Pulverized coal is entrained in the air flowing through the mill housing 103 toward the outlet 109. Before the air and pulverized coal reach the outlet 109, they flow through a classifier 165 (e.g., at the top of the mill housing 103) that allows finely ground coal particles to remain entrained in the air flow and exit the housing through the outlet, while causing larger coal particles that are entrained in the air flow to fall back onto the mill bowl 117 for further grinding.

A conduit 171 suitably connects the outlet 109 of the mill housing 103 to an impeller housing 173 of the exhauster 161 to convey the mixture of air and powdered coal from the mill housing to the impeller housing. An impeller (not shown) in the impeller housing 173 generates the suction that sustains air flow through the mill housing 103. The impeller also blows the mixture of air and powdered coal into a coal burner 175 through an exhauster outlet 177. As indicated schematically in FIG. 2, the exhauster outlet 177 of the illustrated embodiment is connected via a manifold 179 to four separate coal burners 175 of a steam generating boiler of a coal fired power plant. The coal burner(s) 175 can be used in other applications within the scope of the invention.

The air inlet 105 of the mill housing 103 is connected to a duct 181 extending away from the air inlet so that the exhauster 161 draws air from the duct into the air inlet of the mill housing. Upstream of the mill housing 103, the duct branches into a hot air supply duct 183 and a cold air supply duct 185. The hot air supply duct 183 is suitably connected to a source of relatively hotter air and the cold air supply duct 185 is connected to a source of relatively cooler air so that the air drawn into the mill housing 103 can be a mixture of hot and cold air. The words "hot", "heated", "cold", "cooler" and the like are used in reference to a difference between the relative temperatures of the air in the respective ducts 183, 185. The cold or relatively cooler air referred to herein may have a temperature high enough to be considered hot in other contexts and may be heated to some degree (e.g., by proximity to the coal burner or its exhaust). However, the temperature of the cold or relatively cooler air is less than the temperature of the hot air despite any such heating.

As indicated in FIG. 2, for example, the hot air supply duct 183 is suitably connected to a supply of air diverted from (or heated by) exhaust gases from the coal burner(s) 175 and the cold air supply duct 185 is suitably connected to the ambient air (e.g., the air in a room containing the mill housing as indicated in FIG. 2). For instance, a conventional heat exchanger 189 (e.g., one of various known pre-heaters known in the field of coal fired power plants) may be used to transfer heat from the flue gases to the air supplied to the hot air supply duct 183. The hot air supply may include a significant amount of particulate matter, such as fly ash, as is typical with known air pre-heaters of this type. An FD (forced draft) fan 191 or other pressurization system is suitably positioned to boost air flow through the heat exchanger 189 into the hot air supply duct 183. For example, the fan/pressurization system 191 may be in the hot air supply duct 183 adjacent the hot air supply or a component of the heat exchanger 189. This pressurization system 191 is suitably operable to raise pressure in the hot air supply duct 183 upstream of the mill housing 103 and upstream of the intersection 195 with the cold air supply duct 185 to a pressure that is higher than the ambient pressure (e.g., a pressure in the range of somewhere around 10 inches of water gauge.

In one embodiment, the heat exchanger 189 provides a common air supply supplying air to each of the gear cases of each of plurality of the mill grinding systems 101. A controller 204 monitors a position of each air inlet dampers 203, 205 providing air to the gear case of each mill grinding system 101 and controls the common air supply (e.g., duct pressure control 206 in FIG. 2) as a function of the monitored positions. The controller 204 comprises a proportional-integral-derivative (PID) control loop which corrects an error between the monitored dampers positions of each air inlet damper 203, 205 of each mill grinding system 101 and a desired set point position for each damper. The positions of the dampers may indicated by controller 215 or the positions may be indicated by position sensors providing signals to the controller 204. The controller 204 adjusts the common air supply by calculating the difference between the position and the desired set point position and then outputting a corrective action via signal 206 that changes the duct pressure (such as by adjusting the speed or torque of fan 191).

In one embodiment, the set point position for the dampers 203 should not greater than 75% open so that the controller 204 increases the air inlet pressure when any one of the damper positions of any one of the mill systems 101 needs to be greater than 75% open in order to maintain the hot air dampers 205 within a range of operability.

Damper 205 controls the cold ambient air flow into duct 181 and is mixed with the hot air from 183, both of which are controlled by the various controllers to optimize total air flow through the mill at various loads and to control mill air-fuel mixture discharge temperatures exiting the mill at 109. In one embodiment, a secondary air system 190 source of air comes from the same forced draft (FD) fan 191 and air heater system from which the coal mills or pulverizers receive their hot air (hot air going to a mill is also referred to as primary air). An optional perforation plate 208 in a duct supplying the secondary air may be used to meter the secondary air flow. In one embodiment, each of corners of the coal burner 175 may be supplied with secondary air. This allows finer control of the pressure within the gear case.

A hot air blast gate 201 is positioned in the hot air supply duct 183 and allows the hot air supply duct to be selectively opened and closed. The blast gate 201 is typically open when the system 101 is in operation and closed when the system is idle. A hot air damper 203 is positioned in the hot air supply duct 183 between the blast gate 203 and the intersection 195 of the hot air supply duct and the cold air supply duct 185. A cold air damper 205 is positioned in the cold air supply duct 185 upstream of the intersection 195 of the hot air supply duct 183 and the cold air supply duct. An exhauster damper 211 is positioned in the conduit 171 between the mill housing outlet 109 and the impeller housing 173 of the exhauster 161.

Each of the dampers 203, 205, 211, which are suitably conventional dampers known to those skilled in the art, is selectively moveable to various positions between an open position in which the damper provides relatively less resistance to air flow through the damper and a closed position in which the damper provides relatively more resistance to air flow through the damper. The dampers 203, 205, 211 allow air flow through the mill housing 103 and the temperature in the mill housing to be regulated, as will be discussed in greater detail below. A temperature sensor (not shown) is positioned to measure a temperature of the mill housing 103 (e.g., by being positioned to measure the temperature of the mixture of air and coal at the outlet 109 of the mill housing) to provide feedback that may be used to regulate the temperature in the mill housing. The dampers 203, 205, 211 are suitably controlled automatically by a controller 215 (e.g., electronic processor), as illustrated in FIG. 2.

Figure 4:
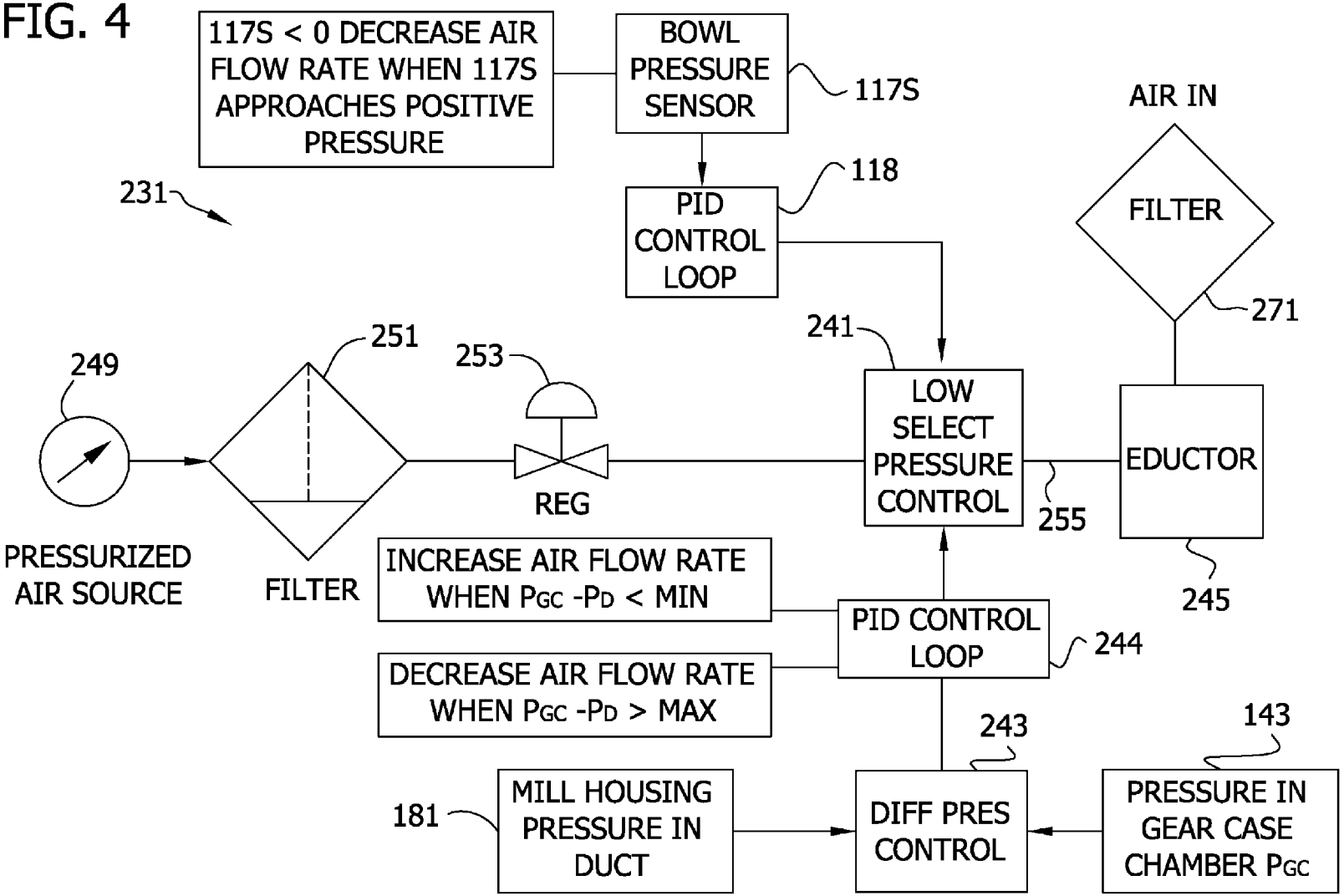
FIG. 4 is a schematic diagram of one embodiment of a gear case chamber pressurization system of the present invention.
Figure 5:
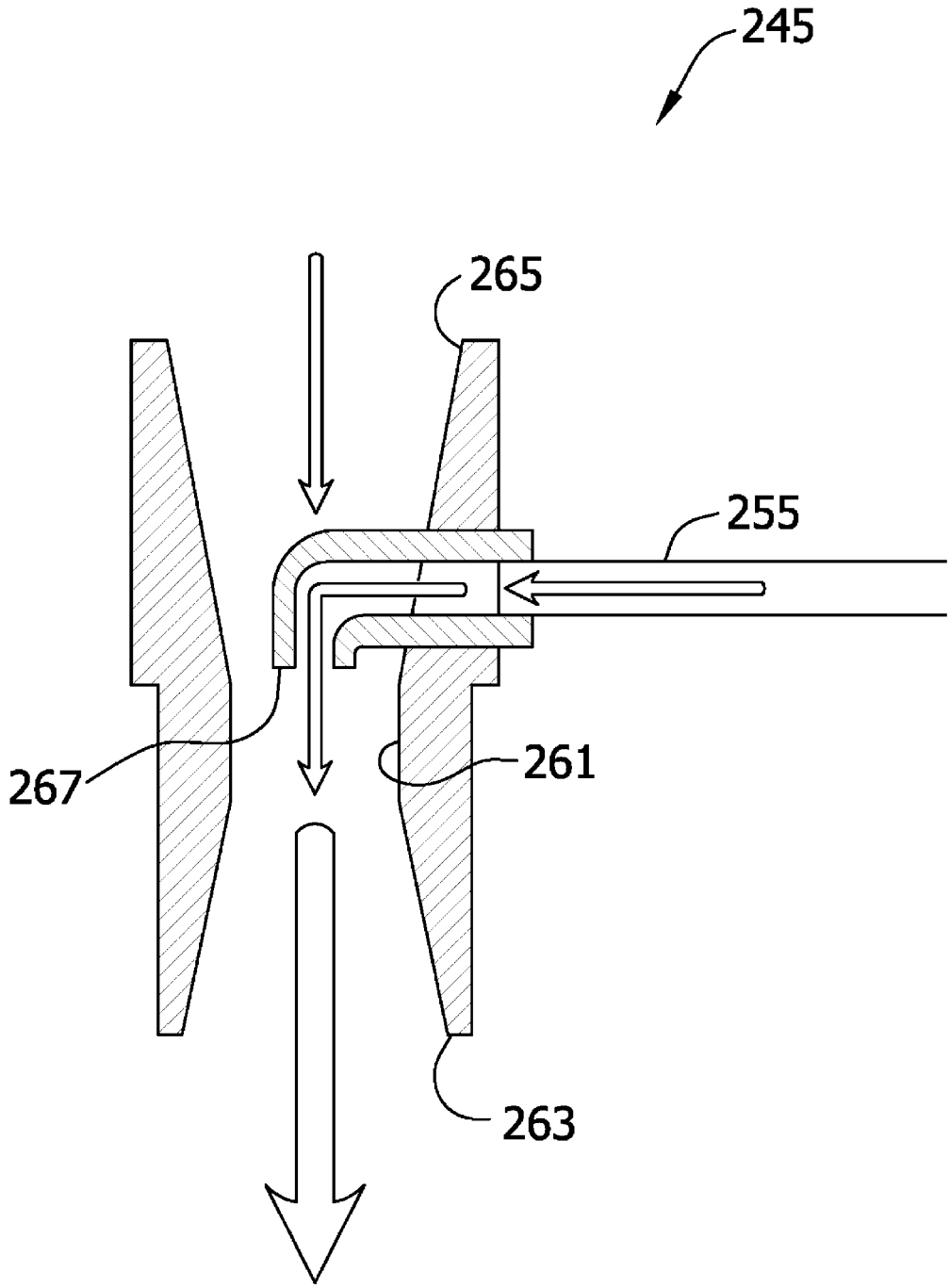
FIG. 5 is a schematic diagram of one embodiment of an eductor of the gear case pressurization system of FIG. 4.

Referring to FIG. 4, the system 101 further comprises a gear case pressurization system, generally designated 231, operable to maintain the gear case pressure in the chamber 143 of the gear case 141 at a pressure higher than the pressure in the mill housing 103 (e.g., as measured at the air inlet 105 to the mill housing). Because the pressure changes gradually in the mill housing 103 and upstream of the mill housing in the duct 181, pressures outside but adjacent the mill housing (e.g., adjacent the mill housing in the duct upstream of the inlet) generally correspond to the pressure in the mill housing. Thus, the gear case pressurization system 231 can maintain the pressure in the gear case 141 at a pressure higher than the pressure in the mill housing 103 by maintaining the gear case pressure at a pressure higher than a pressure outside the mill housing as long as there is a suitable correlation (or negligible difference) between the pressure outside the mill housing and the pressure in the mill housing.

The gear case chamber pressurization system 231 is suitably operable to raise the pressure in the gear case chamber 143 in response to an increase of air pressure in the mill housing 103. Likewise, the gear case chamber pressurization system 231 is suitably operable to reduce the pressure in the gear case chamber 143 in response to a decrease of pressure in the mill housing 103. In one embodiment of the invention, the gear case pressurization system 231 is suitably operable to maintain pressure of the gear case chamber 143 in a predetermined range from about 0.5 to about 1.5 inches of water gauge higher than the pressure in the mill housing 103.

In the particular embodiment illustrated schematically in FIG. 4, for instance, the gear case pressurization system 231 comprises a pressure controller 241, a differential pressure controller 243, and an eductor 245 in fluid communication with the gear case chamber 143. The pressure controller 241 is connected to a pressurized air source 249, such as station control air. A filter 251 and pressure regulator 253 are plumbed in line between the source 249 of pressurized air and the pressure controller 241. The filter 251 removes debris from the pressurized air before it is received by the pressure controller 241. The pressure regulator 253 adjusts the pressure of the pressurized air (e.g., from about 100 psi to about 35 psi) so that air is provided to the pressure controller 241 at a pressure more suitable for use by the pressure controller.

In one embodiment, the pressure controller 241 comprises both a computerized control algorithm within the mill digital control system and a field I/P (electrical current to pneumatic pressure) controller. The pressure controller 241 outputs a relatively small volume air stream that is directed by a conduit 255 to the eductor 245. The pressure controller 241 is operable to vary the rate at which air is directed to the eductor 245, as will be discussed in more detail later.

The eductor 245 in the illustrated embodiment has a venturi 261 having a discharge outlet 263 connected to the gear case chamber 143 and a suction inlet 265 for receiving air into the eductor. The suction inlet 265 of the eductor 245 is suitably positioned to receive air from the exterior of the mill housing 103 into the venturi 2611. A filter (not shown) is suitably positioned to filter air entering the suction inlet 265 of the eductor 245 to filter debris from the air before it reaches the gear case 141. The terminal end of the conduit 255 from the pressure controller 241 defines a port 267 in the venturi. Thus, the air stream from the pressure controller 241 is delivered into the venturi 261 through the port 267. Movement of the air delivered by the pressure controller 241 through the venturi 261 toward the gear case 141 creates a low pressure in the venturi that draws additional air into the eductor 245 through the suction inlet 265. The eductor 245 is designed to amplify the air flow from the pressure controller 241 so that the relatively small variable rate air flow delivered into the eductor by the pressure controller controls a larger volume of air flow from the eductor 245 into the gear case chamber 143.

The differential pressure sensor 243 senses a difference between the pressure in the mill housing 103 (e.g., as measured in the duct 181 adjacent the air inlet 105 to the mill housing) and the gear case chamber 143. As indicated in FIG. 2, the differential pressure sensor 243 has one sensing lead 281 positioned to measure pressure in the mill housing 103 and another sensing lead 283 positioned to measure pressure in the gear case chamber 143. The differential pressure sensor 243 outputs a signal to the pressure controller 241 that is indicative of a difference in the pressure measured in the gear case chamber 143 and the pressure in the mill housing 103 (e.g., as measured at the air inlet 105).

The pressure controller 241 is responsive to the signal from the differential pressure sensor 243 to raise the gear case pressure $P_{GC}$ (e.g., by increasing the rate at which air in the variable rate air flow is delivered to the eductor through the conduit 255 and port 267) when the signal from the differential pressure sensor 243 adjusted by a proportional-integral-derivative (PID) control loop 244 indicates an amount by which the gear case pressure $P_{GC}$ (143) exceeds the air inlet pressure $P_D$ (181) decreases below a specified minimum pressure (i.e., increase air flow rate to eductor 245 when $P_{GC}-P_D<$minimum). The amount the gear case pressure $P_{GC}$ is increased is controlled by the PID control loop 244. Thus, the air inlet pressure is increased when a difference between the gear case pressure less the air inlet pressure is less than a minimum.

Likewise, the pressure controller 241 is responsive to the signal from the differential pressure sensor 243 to lower the pressure $P_{GC}$ in the gear case chamber 134 (e.g., by reducing the rate at which air in the variable rate air flow is delivered to the eductor 245 through the conduit 255 and port 267) if the signal from the differential pressure sensor 243 as adjusted by the PID control loop 244 indicates the amount by which the pressure $P_{GC}$ in the gear case chamber exceeds the pressure $P_D$ at the air inlet increases above a specified maximum pressure (i.e., decrease air flow rate to eductor 245 when $P_{GC}-P_D>$maximum). The amount the gear case pressure $P_{GC}$ is decreased is controlled by the PID control loop 244. Thus, the air inlet pressure is decreased when a difference between the gear case pressure less the air inlet pressure is greater than a maximum.

In addition, the pressure controller 241 is responsive to the bowl pressure sensor 117S signal adjusted by a PID control loop 118 to increase the air flow provided to the eductor 245 as the bowl pressure sensor 117S indicates that the bowl pressure, which is usually negative, is approaching zero and will become a positive pressure. In particular, the hot air damper 203 is decreased as the above bowl case pressure 117 approaches a positive pressure and the rate of decrease is controlled by the mills PID damper controllers.

In one embodiment, the pressure controller 241 is a low select pressure controller meaning that is maintains the pressure in the gear case at the lowest of the pressure value indicated to maintain a negative above bowl pressure per the above bowl pressure PID control loop 118 and the pressure value indicated to maintain the differential pressure per the differential PID control loop 244. Thus, the air inlet pressure is decreased based on the lower of the indication from the bowl pressure PID control loop and the differential pressure PID control loop.

In summary, one embodiment of the invention comprises a duct pressurization system operable to raise an air pressure in the duct upstream of the air inlet of the mill housing to be higher than ambient pressure, to maintain a gear case pressure as negative, to increase the upstream air pressure when a difference between the gear case pressure less the upstream air pressure is less than a minimum, and to decrease the upstream air pressure when a difference between the gear case pressure less the upstream air pressure is greater than a maximum.

In one embodiment of a method of grinding coal into a powder according to the present invention, the coal feed mechanism is used to feed coal into the mill housing 103 through the coal inlet 107 and convey the coal to the milling unit 115. The coal falls from the feed pipe 155 onto the mill bowl 117. The drive shaft 133 is rotated (e.g., using the motor 135) to rotate the gears 137, 139 and thereby move (e.g., rotate) the mill bowl 117. As the mill bowl 117 rotates, coal spreads out and up the inclined peripheral portion 121 of the mill bowl. Coal on the peripheral portion 121 of the mill bowl 117 is ground by the cooperative action of the roller(s) 131 and the mill bowl. The exhauster 161 draws air into the housing 103 through the air inlet 105 and draws a mixture of air and powdered coal out of the mill housing through the outlet 109. Then the exhauster 161 blows the mixture of air and powdered coal into the coal burner 175.

The hot air damper 203 is used to regulate the temperature in the mill housing 103 (e.g., as measured by the temperature sensor (not shown) at the mill housing outlet 109) to maintain the temperature in a range that is hot enough to remove moisture from the coal and to prevent condensation from interfering with the milling operation, but cool enough to limit the risk of premature ignition of the coal. To increase the temperature in the mill housing 103, the hot air damper 203 is moved farther toward its open position to allow more hot air into the mill housing. Conversely, to decrease the temperature in the mill housing 103, the hot air damper 203 is moved toward its closed position to allow less hot air into the mill housing. The amount of heating that is required to maintain the temperature in the desired range will depend on various factors, including the rate at which coal is fed into the mill housing 103, the moisture content of the coal, etc. Generally, when the mill system 101 operates under low loading, the amount of coal that needs to be heated and dried per unit of time is less than when the mill operates under heavier loading. Thus, when operating the mill system 101 under low loading conditions, the hot air damper 203 is typically closer to its closed position than it is under heavy loading conditions to restrict flow of hot air into the housing 103.

The cold air damper 205 is used to regulate pressure in the mill housing 103 (e.g., at the air inlet 105) to help minimize the impact adjustment to the hot air damper 203 has on air flow through the mill housing. The cold air damper 205 is moved farther toward its open position to increase pressure in the mill housing 103 (e.g., in response to movement of the hot air damper 203 toward its closed position). Conversely, the cold air damper 205 is moved farther toward its closed position to decrease the pressure in the mill housing 103 (e.g., in response to movement of the hot air damper toward its open position).

When the mill system 101 is operating under high loading conditions, the pressure in the hot air supply duct 183 upstream of the hot air damper 203 is suitably pressurized to a pressure above the ambient pressure (e.g., to a pressure that is from about 3 to about 8 and preferably including 6.5 inches of water gauge to increase flow of hot air from the hot air supply to the mill housing 103. The dampers 203, 205, 211 are suitably positioned and the duct pressurization system 191 operated so that the pressure at the air inlet 105 of the housing 103 is at no less than about 1.5 inches of water gauge below the ambient pressure, more suitably no less than about 0.75 inches of water gauge below the ambient pressure, still more suitably at least about equal to the ambient pressure, and even more suitably above the ambient pressure. When the load on the mill system 101 decreases, the dampers 201, 203, 211 and/or duct pressurization system 191 are suitably adjusted to reduce the pressure at the air inlet to the mill housing (i.e., increase the suction pressure at the air inlet). In addition to the FD fan 191 on the front end, an ID (induced draft) outlet fan on the back end may be used to draw air from the gear case to maintain a negative pressure.

Figure 6:
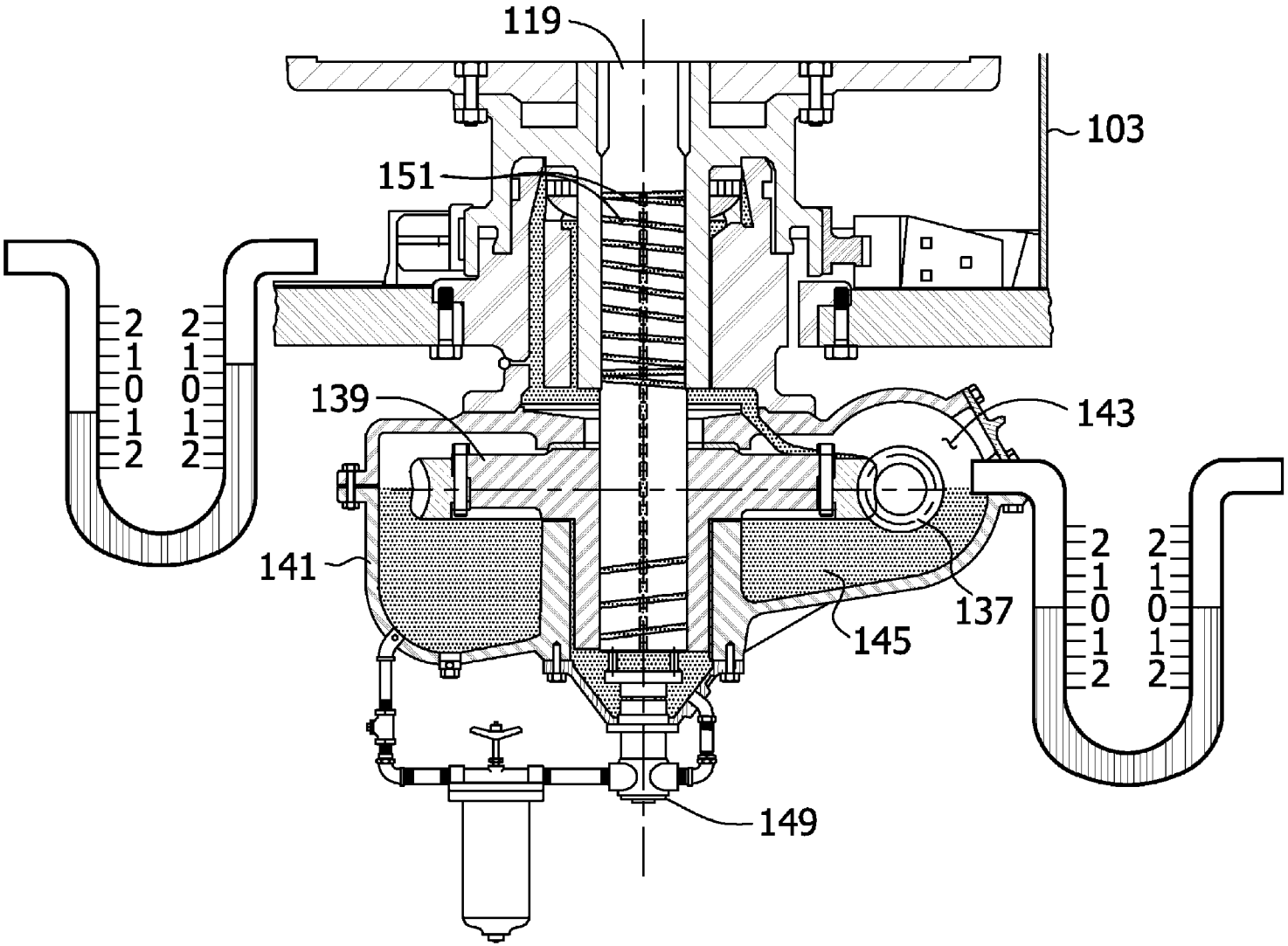
FIGS. 6-7 illustrate a response of the coal milling system to a pressure change at an air inlet into the mill housing.
Figure 7:
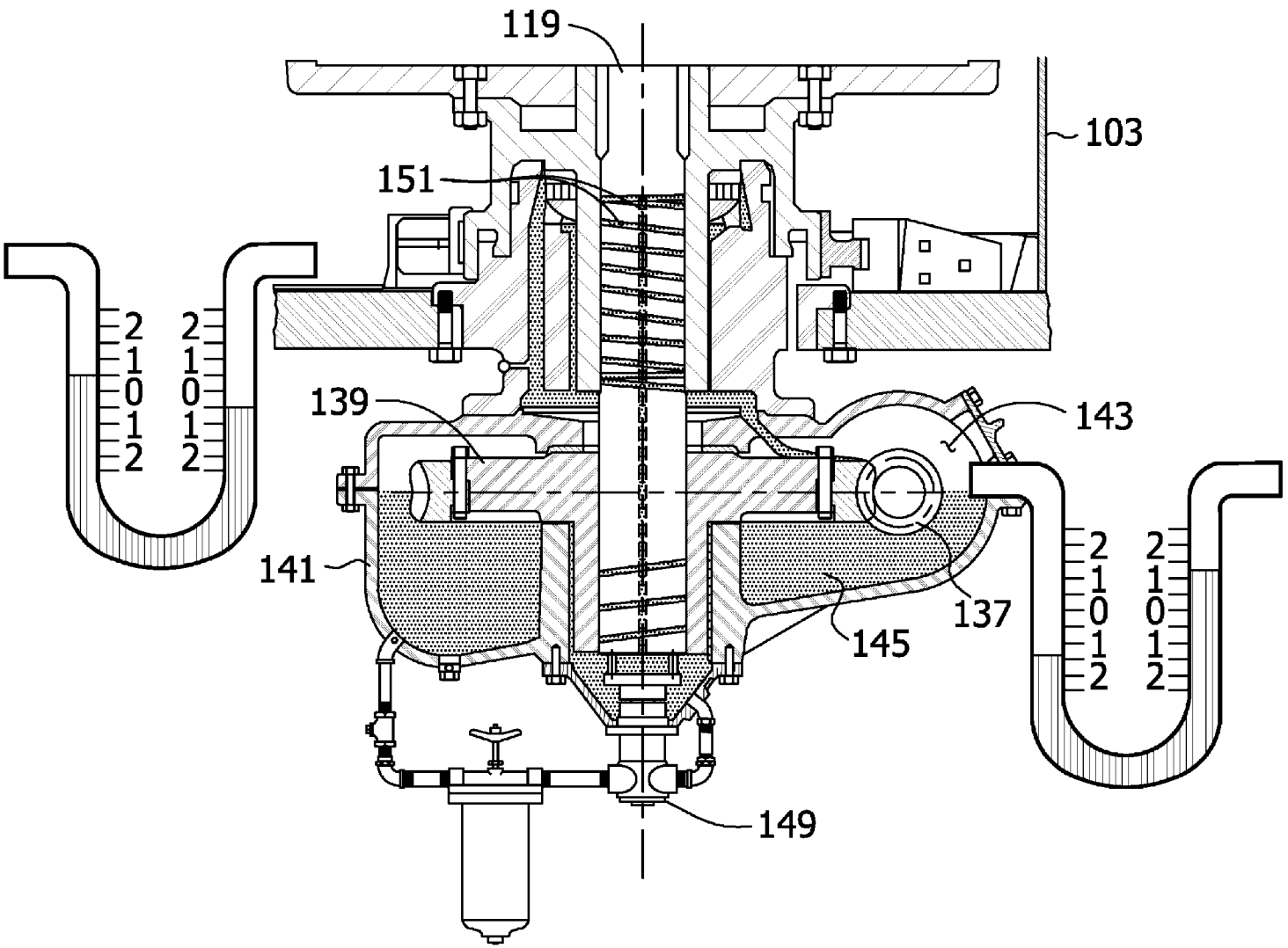

The gear case chamber pressurization system 231 maintains the gear case pressure at a pressure that is higher than the air inlet pressure of the mill housing 103 (broadly, the pressure inside the mill housing). For instance, when the pressure at the air inlet 105 is increased (e.g., as indicated in the sequence illustrated in FIGS. 6 and 7) for operation of the mill under higher loading conditions, as discussed above, the gear case pressurization system 231 raises the gear case pressure. Likewise, when the pressure in the mill housing 103 is decreased for operation under lighter loading conditions, the gear case pressurization system 231 suitably lowers the gear case pressure to maintain about the same pressure difference between the pressure in the mill housing 103 and the pressure in the chamber 143 of the gear case 141. In one embodiment of the invention, the pressure in the gear case chamber 143 is maintained at a pressure substantially in the range of about 1 to about 2 inches of water gauge (e.g., about 1.5 inches of water gauge) higher than the air pressure in the mill housing 103 as measured at the air inlet 105.

When the gear case pressurization system 231 illustrated in FIG. 4 is used, the differential pressure sensor 243 monitors (either continuously or periodically) the difference in pressure between the mill housing 103 and the gear case chamber 143 and sends a signal indicative thereof to the pressure controller 241. When the difference between the pressure in the gear case chamber 134 and the mill housing 103 falls below a specified value, the pressure controller 241 increases the rate at which it delivers air into the venturi 261 through the port 267. Increasing the rate at which air is delivered into the venturi 261 increases the rate at which air is drawn into the eductor suction inlet 265 and directed into the gear case chamber 143. This increases the amount of air that in the gear case chamber 143 and increases the gear case pressure.

Although the embodiments described in detail herein refer to flow of "air" through various parts of the mill grinding system 101, it is understood that the term air is used in a generic manner to refer to any gas or mixture of gases suitable for moving powdered coal out of the mill housing. In particular, it is understood that it may be desirable in some instances to use air in one or more parts of the system that is substantially devoid of oxygen to reduce the risk of premature combustion of the coal.

When introducing elements of the present invention or the preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. In a system for grinding coal into a powder and supplying powdered coal to a burner, wherein the system comprises a plurality of mill grinding systems, each mill grinding system comprising:

a mill housing having a coal inlet, an air inlet, and an outlet;

a milling unit in the mill housing, the milling unit being operable to receive coal that enters the housing through the coal inlet, the milling unit comprising a moveable milling member operable to grind the coal into a powder when the milling member moves;

a drive system for moving the milling member, the drive system including a powered drive shaft and at least one gear for drivingly connecting the milling member to the drive shaft so that rotation of the drive shaft moves the milling member;

a gear case defining a chamber, said at least one gear being in the chamber;

an exhauster connected to the outlet of the mill housing, the exhauster being operable to draw air into the mill housing through the air inlet and further draw a mixture of air and powdered coal out of the mill housing through the outlet for delivery of the powdered coal to the burner; and a gear case pressurization system operable to maintain a gear case pressure in the gear case at a higher pressure than an air inlet pressure at the air inlet by controlling an air inlet damper which the air supply to the gear case;

the improvement comprising:

a common air supply supplying air to each of the gear cases of each of the mill grinding systems;

a controller monitoring a position of each air inlet damper providing air to the gear case of each mill grinding system and for controlling the common air supply as a function of the monitored positions.

2. The system as set forth in claim 1 wherein the controller comprises a proportional-integral-derivative (PID) controller which corrects an error between the monitored damper position of each air inlet damper of each mill grinding system and a desired set point position for each damper by adjusting the common air supply.

3. The system as set forth in claim 2 wherein the set point position for the damper is not greater than 75% open and wherein controller increases the air inlet pressure when any one of the damper positions needs to be greater than 75% open in order to maintain the gear case pressure at a higher pressure than air inlet pressure.

4. The system as set forth in claim 1 further comprising a secondary air system supplying secondary air to the burner, and a perforation plate in a duct supplying the secondary air for metering the secondary air flow.

5. A system as set forth in claim 1 further comprising: a duct connected to the air inlet for delivering air to said air inlet, the exhauster being operable to draw air from the duct into the air inlet of the mill housing; and a duct pressurization system operable to raise an air pressure in the duct upstream of the air inlet of the mill housing to a pressure higher than ambient pressure.

6. A system as set forth in claim 5 wherein another end of the duct is connected to a source of hot air, the hot air comprising particulate matter and wherein the duct pressurization system is operable to maintain a gear case pressure as negative, to increase the upstream air pressure when a difference between the gear case pressure less the upstream air pressure is less than a minimum, and to decrease the upstream air pressure when a difference between the gear case pressure less the upstream air pressure is greater than a maximum.

7. A system as set forth in claim 6, wherein said particulate matter comprises fly ash and wherein the source of hot air comprises air that has been heated by the burner.

8. A system as set forth in claim 1, wherein the gear case pressurization system comprises a pressure controller operable to adjust the gear case pressure in response to a change in the air inlet pressure.

9. A system as set forth in claim 8, wherein the gear case pressurization system further comprises a differential pressure sensor operable to send a signal to the pressure controller indicative of a difference between the gear case pressure and the air inlet pressure, the pressure controller being responsive to the signal from the differential pressure sensor to adjust the gear case pressure when the difference between the gear case pressure and the air inlet pressure falls outside of a predetermined range.

10. A system as set forth in claim 8, wherein the gear case pressurization system further comprises an eductor comprising a venturi having a discharge outlet open to the gear case chamber and a suction inlet for receiving air from exterior of the mill housing into the eductor, the eductor further comprising a port in the venturi, the pressure controller being operable to deliver air into the venturi through the port at a variable rate, the pressure controller being operable to increase said variable rate to raise the pressure in the gearbox.

11. A system as set forth in claim 10, further comprising a filter positioned to filter air received into the suction inlet before it enters the gear case chamber.

12. A system as set forth in claim 10, wherein the pressure controller is operable to decrease the rate at which air is delivered to the port to lower the gear case pressure.

13. A system as set forth in claim 1 further comprising:

a duct connected at one end to the air inlet of the mill housing so that the exhauster is operable to draw air from the duct into the mill housing through the air inlet, another end of the duct being connected to a source of hot air, the hot air comprising particulate matter; and a duct pressurization system operable to raise an air pressure in the duct upstream of the air inlet of the mill housing to be higher than ambient pressure, to maintain a gear case pressure as negative, to increase the upstream air pressure when a difference between the gear case pressure less the upstream air pressure is less than a minimum, and to decrease the upstream air pressure when a difference between the gear case pressure less the upstream air pressure is greater than a maximum.

14. A system as set forth in claim 13, wherein said particulate matter comprises fly ash and wherein the source of hot air comprises air that has been heated by the burner.

* * * * *